US006009975A

United States Patent [19]

Coenders

[11] Patent Number: 6,009,975

[45] Date of Patent: Jan. 4, 2000

[54] ADJUSTABLE WORKING PLATFORM CONSTRUCTION

[75] Inventor: Petrus Martinus A.G. Coenders, Tilburg, Netherlands

[73] Assignee: Safety Floor B.V., Tilburg, Netherlands

[21] Appl. No.: 09/117,393

[22] PCT Filed: Jan. 29, 1997

[86] PCT No.: PCT/NL97/00026

§ 371 Date: Jul. 29, 1998

§ 102(e) Date: Jul. 29, 1998

[87] PCT Pub. No.: WO97/28331

PCT Pub. Date: Aug. 7, 1997

[30] Foreign Application Priority Data

Jan. 29, 1996 [NL] Netherlands ..... 1002196

[51] Int. Cl.[7] ..... E04G 3/10

[52] U.S. Cl. ..... 182/128; 182/223

[58] Field of Search ..... 182/128, 223, 182/150

[56] References Cited

U.S. PATENT DOCUMENTS

| | | | |
|---|---|---|---|
| 1,213,043 | 1/1917 | Walker | 182/128 |
| 1,380,074 | 5/1921 | Myers | 182/128 |
| 3,080,941 | 3/1963 | Fuller | 182/152 |
| 4,095,670 | 6/1978 | Martin | 182/128 |
| 4,125,174 | 11/1978 | Genhard | 182/128 |
| 5,183,625 | 2/1993 | Bastistoni | 182/128 |

FOREIGN PATENT DOCUMENTS

| | | | |
|---|---|---|---|
| 258987 | 4/1967 | Austria | 182/128 |
| 826971 | 11/1951 | Germany . | |
| 3920806 | 1/1991 | Germany . | |
| 573555 | 9/1971 | U.S.S.R. | 182/128 |
| 485205 | 1/1976 | U.S.S.R. | 182/128 |
| 7875 | 12/1917 | United Kingdom . | |

*Primary Examiner*—Alvin Chin-Shue

*Attorney, Agent, or Firm*—Jacobson, Price, Holman & Stern, PLLC

[57] ABSTRACT

An adjustable working platform construction suitable for being used in distillation columns and the like. The working platform can be supported on rings present on the inner side of the column wall. The working platform is built up of a system of spokes which are connected to a central plate. Two diametrically opposed first spokes are fixedly connected to the plate and at least two pairs of second spokes positioned on either side of the first spokes are pivotably connected to the plate. Two third spokes, which are arranged in diametrically opposed relationship, are detachably accommodated in receiving holes in the central plate. The system of spokes supports cover plates, which are shaped to cover the entire column section.

8 Claims, 4 Drawing Sheets

ADJUSTABLE WORKING PLATFORM CONSTRUCTION

FIELD OF THE INVENTION

The invention relates to an adjustable working platform construction suitable for being used in distillation columns and the like, whereby the working platform can be supported on rings present on the inner side of the column wall.

BACKGROUND OF THE INVENTION

Distillation columns as used in refineries and chemical companies are tower-like structures, which are substantially built up of a cylindrical outer wall having a height in the order of 100 m and more, whereby the outer wall is provided with rings which are welded to the inner side of said wall in regularly spaced-apart relationship, on which rings the distilling dishes are supported. The outer wall of said columns is provided with manholes at regular intervals, through which access can be gained to the inside of the column for inspecting the dishes and for carrying out repairs and installation work. All the materials needed for carrying out various activities, such as the installation of new dishes, the carrying out of repairs to existing dishes and the modification of dishes, must be introduced into the inside of the column via said manholes. In order to be able to carry out these activities more quickly, operators have proceeded to carry out these activities simultaneously in several sections the last few years. This constitutes a safety hazard, however, because several people are working one above the other and it regularly happens that tools, welding spatter or screw materials fall down the column. In order to overcome this problem operators have proceeded to place wooden planks on the rings, which planks are to function as a temporary working platform. The drawbacks of these wooden working platforms are that they constitute a fire hazard, that they are not strong enough, that refuse of the materials being used is not possible, that the column section is not entirely covered in an optimum manner, and that there is a risk of the planks present on the rings turning over. What makes matters worse is the fact that the planks being used may only have a limited width, since they must be introduced into the column through said manholes, and generally the diameter of said manholes is only in the order of 50 cm.

SUMMARY OF THE INVENTION

The object of the invention is to provide a working platform construction which obviates the above drawbacks and which is safe, non-flammable and easy to install and which furthermore consists of few parts of simple construction. In order to accomplish that objective the working platform construction according to the invention is characterized in that it is built up of a system of spokes which are connected to a central plate, whereby two diametrically opposed first spokes are fixedly connected to said plate and at least two pairs of second spokes positioned on either side of said first spokes are pivotably connected to said plate, and whereby two third spokes, which are arranged in diametrically opposed relationship, are detachably accommodated in receiving holes in said central plate, whereby said system of spokes supports cover plates, which are shaped to cover the entire column section. Since said second spokes are pivotably connected to the central plate, said spokes may abut against said first spokes prior to installation, so that a unit is obtained which can readily be installed through a manhole. Said unit is introduced into the interior of the column through the manhole, whereby the first spokes will be supported on a ring present inside the column. Then the second spokes are pivoted away from the first spokes into abutment with the column wall, after which the third spokes are finally placed in the receiving holes in the central plate, thus providing a stable system of spokes which is supported on a ring inside the column. Then said system of spokes is covered by cover plates, which are shaped to cover the entire column section. Said spokes and said cover plates may be made of an non-flammable material, such as aluminium or another light metal.

In order to be able to use the system of spokes for columns having different diameters, another advantageous embodiment of the working platform construction according to the invention is characterized in that said spokes are adjustable in length.

Another embodiment of the working platform construction according to the invention is characterized in that the outwardly directed spokes are each provided with a threaded stud, which can be moved in the longitudinal direction of the spoke in question by suitable means, each stud being provided with a block of material which is capable of abutment against the column wall and of being supported on a ring. The stud may for example be moved outwards or inwards by means of a nut provided thereon, whereby said block of material is firmly pressed against the column wall. In this manner the system of spokes is firmly secured within the column, which benefits its stability.

According to another advantageous embodiment said second spokes, which are pivotably connected to said plate, can be moved in pairs away from and towards said first fixed spoke by mechanical means. The mechanical means may thereby be made up of two sliding blocks provided on said first fixed spokes, each sliding block being connected, via two levers pivotably connected thereto, to two associated pivoting spokes, whereby each sliding block is coupled to a winch mechanism via a cable transmission. After the first fixed spokes have been placed on a ring the pivoting spokes can thus be moved by the winch mechanism to a position in which the latter spokes are also supported on the ring in question.

According to another embodiment of the working platform construction in accordance with the invention four sets of cover plates are supported on said spokes, whereby each set covers a quadrant of the column section and each set comprises a first inner plate, which abuts against the central plate with one side and which abuts against a second plate with its other side, said second plate in turn abutting against a third plate, which in turn abuts against two fourth plates, which are circular at their outer sides, whereby the abutting sides of said second and third plates and those of said third and fourth plates extend parallel to the chords of the outer sides of the fourth plates, whereby the largest radial dimension of each of the plates is smaller than the diameter of the manholes present in the column wall. In this manner a complete covering of the column section has been obtained while using a limited number of plates, which are dimensioned such that they can readily be supplied through the manholes that are present. In another embodiment of the working platform construction said first and second plates as well as said third and fourth plates are pivotably interconnected in order to achieve a further reduction of the number of loose plates.

The working platform construction according to the invention provides a large measure of safety, because the entire column section is covered and can be placed on the rings in a very stable manner. The working platform construction may furthermore be made in the form of a light and non-flammable unit of aluminium or a light metal. The working platform furthermore consists of few parts and can readily be moved and re-used.

BRIEF DESCRIPTION OF THE DRAWINGS

The invention will be explained in more detail hereafter with reference to a drawing, which shows a few embodiments of a working platform by way of illustration.

DETAILED DESCRIPTION OF THE PREFERRED EMBODIMENTS

Figure 1:
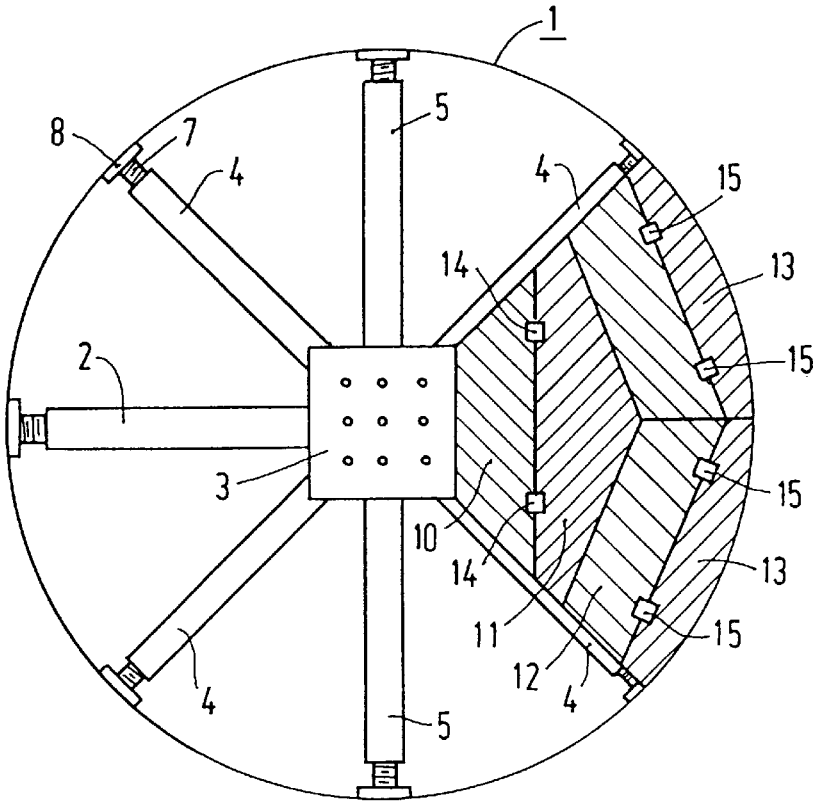
FIG. 1 is a schematic plan view of a working platform construction, wherein only part of the working platform is provided with cover plates.
Figure 2:
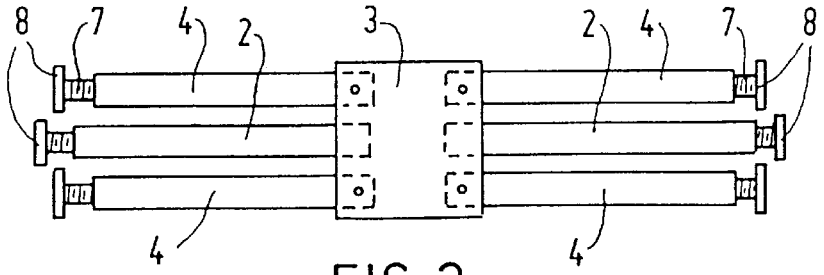
FIGS. 2 and 3 are a plan view and a side view respectively of a part of the system of spokes in folded condition.
Figure 3:
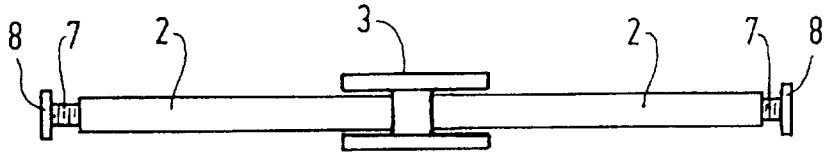

In FIG. 1 the circumference of the inside wall of a column is schematically indicated at 1. Provided within said column wall is a system of spokes, which is built up of two first spokes 2, which are arranged in diametrically opposed relationship and which are fixedly connected to a central plate 3. Also connected to said central plate 3 are two pairs of pivoting spokes 4 positioned on either side of fixed spokes 2. Furthermore two diametrically opposed spokes 5 are provided in receiving holes in central plate 3. Central plate 3 and the fixed spokes 2 connected thereto, as well as the spokes 4 being pivotably connected thereto are shown in more detail in folded condition in FIGS. 2 and 3, from which Figures it becomes apparent that in folded condition the assembly of said spokes and said central plate 3 has a very limited cross-sectional dimension. From said Figures it is furthermore apparent that plate 3 is in fact built up of two parallel plates with a connecting piece therebetween. All spokes are provided with a threaded stud 7 at their outward ends, to which studs a block of material 8 is connected. The placing of the system of spokes in the interior of a column is carried out in the following manner; the system of spokes in the folded condition shown in FIG. 2 is introduced into the interior of the column through a manhole present in the column wall, then the ends of the fixed spokes 2 are placed on a ring present within said column, after which spokes 4 are unfolded, so that also these spokes will come into contact with the column wall and with the ring. Following that the two spokes 5 are provided in central plate 3 and adjusted for length in such a manner that they will be supported on said ring. When stud 7 is screwed out the material block 8 of each of the spokes is pressed against the inside wall of column 1, so that the spoke wheel is firmly and stably secured within column 1. Thereafter cover plates are placed on the system of spokes. Each system of cover plates covers a quadrant of the column section, whereby said system of cover plates comprises one plate 10, which abuts against central plate 3 on one side, one plate 11, one plate 12 and two plates 13. Plates 13 are circular on their outer sides, said circular configuration corresponding with the configuration of the inside wall 1 of the column. The sides of plates 3 abutting plate 13 and the side of plate 12 abutting plate 11 have a configuration which runs parallel to the chords of the outer side of plates 13. Plates 10 are hinged together by means of hinges 14, so that said assembly of plates is foldable, which makes it easier to introduce said plates into the column. It is furthermore noted that the radial dimension of each of the plates 10, 11 and 12 is smaller than the dimension of the manhole through which said plates must be introduced into the column. Although only one of the quadrants of the column section is provided with cover plates in FIG. 1, it will be apparent that in practice all four quadrants will be provided with cover plates in the same manner.

Figure 4:
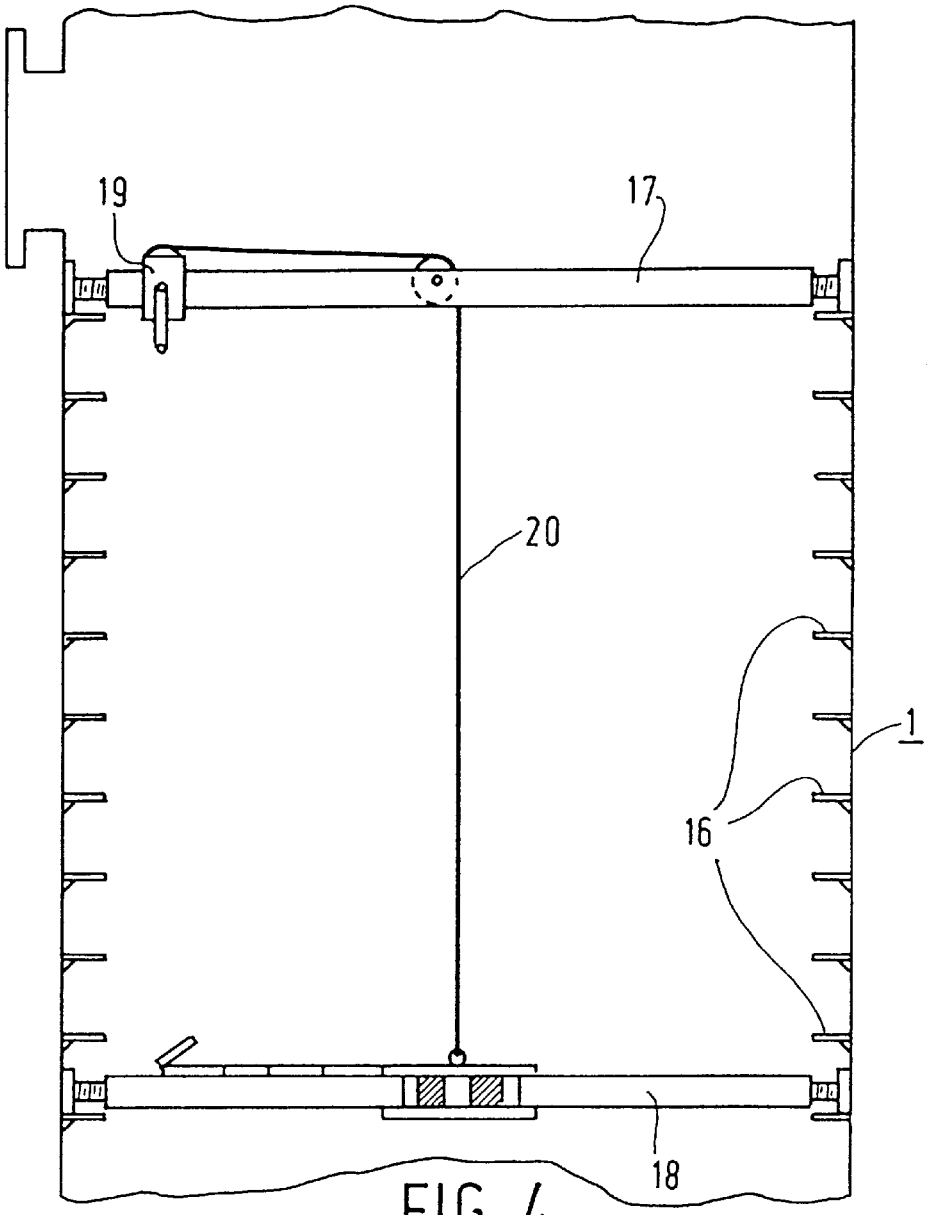
FIGS. 4 and 5 schematically show, in sectional view and in plan view respectively, how a working platform can be placed in the column wall by means of a hand-operated winch.
Figure 5:
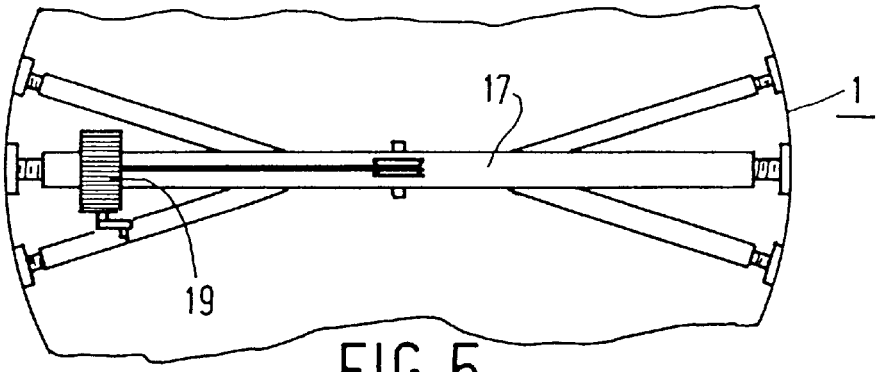
Figure 6:
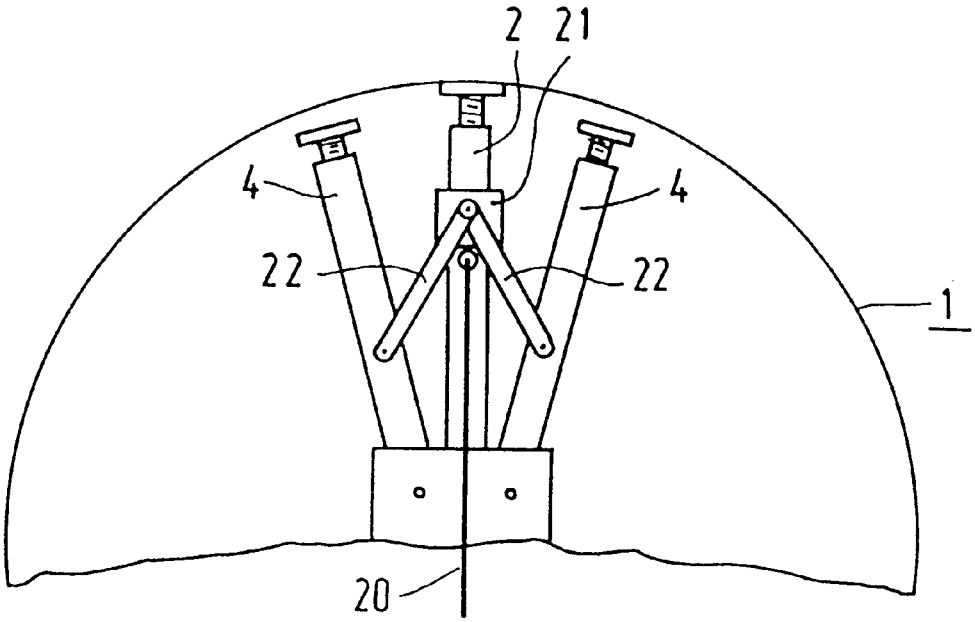
FIGS. 6 and 7 schematically show how the system of spokes can be placed within the column wall.
Figure 7:
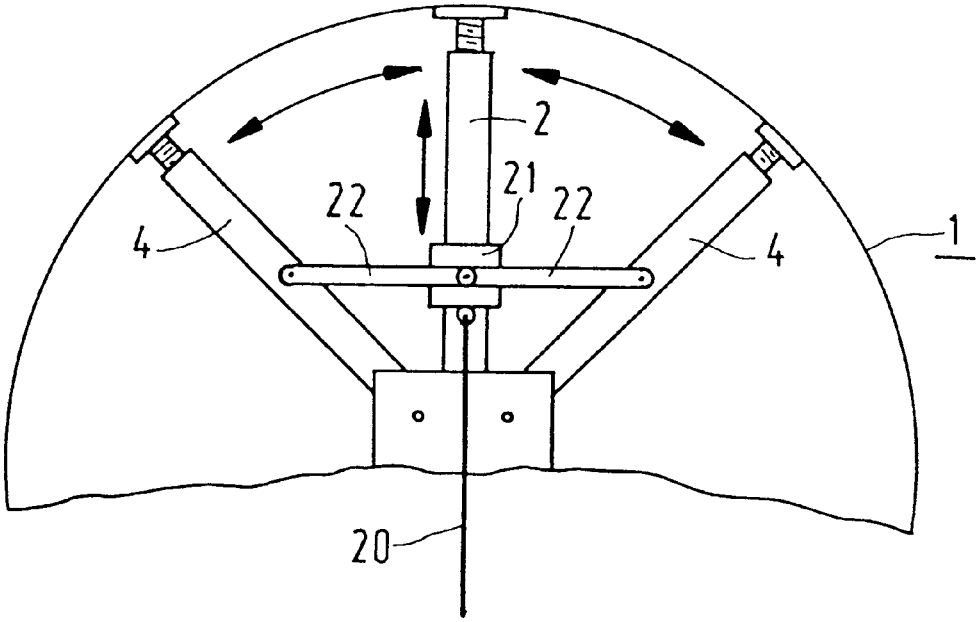

FIGS. 4 and 5 schematically show a part of a column, whereby a column wall 1 is on its inner side provided with rings 16, which supports a system of spokes 17 and a system of spokes 18. Said system of spokes 17 is thereby provided with a hand-operated winch 19, which is connected to said second system of spokes 18 via a cable 20. As is shown in FIGS. 6 and 7, said cable 20 is connected to a sliding block 21, which is slidably mounted on fixed spoke 2 of the system of spokes. Sliding block 21 is connected, by means of levers 22, to each of the pivotable spokes 4 positioned on either side of the fixed spoke 2. When a pulling force is exerted on cable 20 by means of hand-operated winch 19, this will cause sliding block 21 and thus spokes 4 to move from the position shown in FIG. 6 to the position shown in FIG. 7. In this manner the system of spokes is now moved by means of hand-operated winch 19, instead of by hand, from the position in which it is introduced into the column to the working position shown in FIG. 7.

Figure 8:
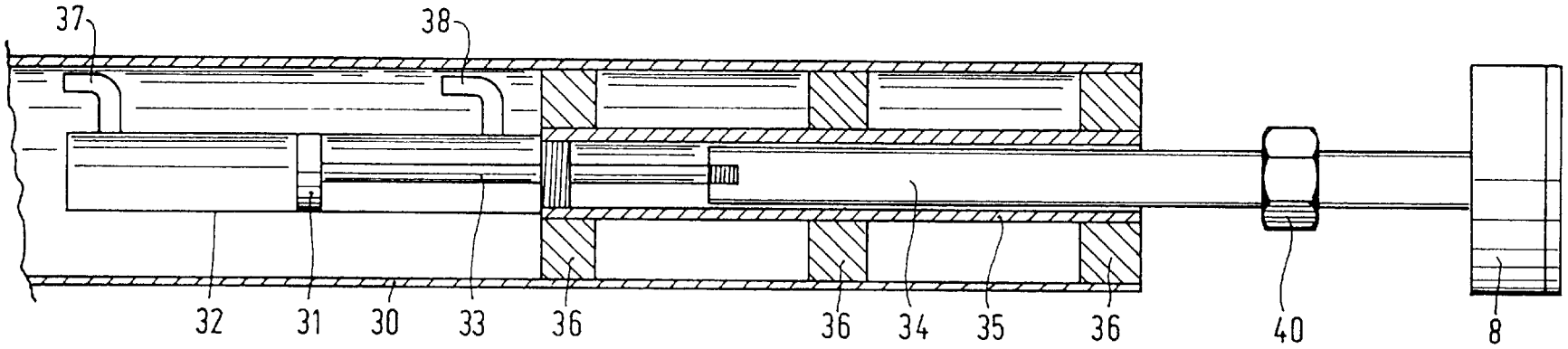
FIG. 8 is a schematic, larger-scale view of a part of a spoke, which spoke is provided with a piston-cylinder combination.

FIG. 8 is a partial view of a part of a spoke 30. In this Figure a combination of a piston 31 and a cylinder 32 is disposed within the spoke. Piston 31 is thereby connected to a piston rod 33, which is in turn coupled to a threaded stud 34, which is movable within a tube 35, which is for example made of aluminium. Tube 35 is supported on the inside of spoke 30 via supporting blocks 36. A pressure medium, in particular compressed air, can be supplied to piston-cylinder combination 32, 31 via inlets 37 and 38. To that end inlets 37, 38 may be connected, via flexible piping and adjustable valves, to a source of compressed air, for example a compressor.

When compressed air is supplied to inlet 37, piston 31 will be pressed to the right and the supporting block 8 present on stud 34 will engage the wall of the column in which the working platform is to be installed.

When the inlets 37 of the piston-cylinder combinations of all spokes are simultaneously supplied with medium, all supporting blocks 8 will engage the column wall, whereby central plate 3 will automatically be positioned in the centre of the column. After all supporting blocks have engaged the column wall, their respective studs will be fixed in the spoke by tightening locking nut 40 until said studs abut against the end of the spoke. This will lock the system of spokes into position in the column.

From the above it will be apparent that the invention provides a very simple solution for the problem of building up a working platform within a distillation column. The introducing of the various parts through manholes of limited dimensions can take place in a very simple manner thereby, after which unfolding of the system of spokes within the column will result in a very stable and safe position of the working platform in the column. Furthermore the risk of tools or other parts of the construction falling down the column is fully eliminated as a result of the entire column section being covered by cover plates.

I claim:

1. An adjustable working platform construction for use in distillation columns, whereby the working platform can be supported on rings present on an inner side of a column wall, said working platform comprising:

a system of spokes which are connected to a central plate, whereby two diametrically opposed first spokes are fixedly connected to said central plate and at least two pairs of second spokes positioned on either side of said first spokes are pivotably connected to said central plate and whereby said system of spokes supports cover plates, which are shaped to cover an entire column section, and through spokes are fixedly connected to said central plate and two third spokes, which are arranged in diametrically opposed relationship, are detachably accommodated in receiving holes in said central plate.

2. An adjustable working platform construction according to claim 1, wherein said spokes are adjustable in length.

3. An adjustable working platform construction according to claim 1, wherein said first, second and third spokes are each provided with a threaded stud, which can be moved in a longitudinal direction of each spoke, each stud being provided with a block of material which is capable of abutment against the column wall and of being supported on a ring.

4. An adjustable working platform construction according to claim 1, wherein said second spokes, which are pivotably connected to said central plate, being moved in pairs away from and towards one of said first fixed spokes.

5. An adjustable working platform construction according to claim 4, wherein said second spokes are movable by two sliding blocks provided on said first fixed spokes, each sliding block being connected, via two levers pivotably connected thereto, to two associated pivoting spokes, and each sliding block being coupled to a winch mechanism via a cable transmission.

6. An adjustable working platform construction according to claim 1, wherein four sets of said cover plates are supported on said spokes, whereby each set of said cover plates covers a quadrant of the column section and each set of said cover plates comprises a first inner plate, which abuts against the central plate with one side and which abuts against a second plate with another side, said second plate in turn abutting against a third plate, which in turn abuts against two fourth plates, which are circular at outer sides, whereby abutting sides of said second and third plates and abutting sides of said third and fourth plates extend parallel to chords of the outer sides of the fourth plates, whereby a largest radial dimension of each of the cover plates is smaller than a diameter of manholes present in the column wall.

7. An adjustable working platform construction according to claim 6, wherein said first and second plates as well as said third and fourth plates are pivotably interconnected.

8. An adjustable working platform construction according to claim 5, wherein each of said spokes comprises a piston-cylinder combination, to which a pressure medium may be supplied.

* * * * *